United States Patent [19]

Gerry

[11] 4,377,151

[45] Mar. 22, 1983

[54] BIPOLAR ACTIVATED MAGNETIC PULSE TIMER

[76] Inventor: Martin E. Gerry, 13452 Winthrope St., Santa Ana, Calif. 92705

[21] Appl. No.: 366,222

[22] Filed: Apr. 7, 1982

Related U.S. Application Data

[63] Continuation-in-part of Ser. No. 282,755, Jul. 13, 1981, and Ser. No. 336,506, Dec. 31, 1981.

[51] Int. Cl.[3] ..... F02P 1/00

[52] U.S. Cl. ..... 123/618; 123/651; 123/617

[58] Field of Search ..... 123/650, 651, 652, 617, 123/618, 606; 315/209 T, 209 CD

[56] References Cited

U.S. PATENT DOCUMENTS

| | | | |
|---|---|---|---|
| 3,211,954 | 10/1965 | Shano | 123/617 |
| 3,253,168 | 5/1966 | Robbins | 123/617 |
| 3,297,009 | 1/1967 | Sasaki | 123/617 |
| 4,249,506 | 2/1981 | Tada | 123/618 |

FOREIGN PATENT DOCUMENTS

| | | | |
|---|---|---|---|
| 50-44342 | 10/1975 | Japan | 123/618 |
| 1222999 | 3/1968 | United Kingdom | 123/618 |

*Primary Examiner*—Ronald B. Cox

[57] ABSTRACT

A bipolar activated magnetic pulse timer (50, $Q_a$, $Q_b$) is shown for an ignition system (Q1, Q2, Qn, Qp, 80, 90, 40, 40*a*) of a fuel burning engine. Such system includes a pair of semiconductor switches ($Q_a$, $Q_b$) wherein the output circuits of such switches are serially connected. A magnetic pulse timer (50) having an output winding (53) is connected to the input circuits of such switches. Such switches and timer intermittently activate a variety of ignition circuits.

6 Claims, 7 Drawing Figures

BIPOLAR ACTIVATED MAGNETIC PULSE TIMER

CROSS REFERENCE TO RELATED APPLICATIONS

This application is a continution in part of copending applications Ser. No. 282,755 filed July 13, 1981 and Ser. No. 336,506 filed Dec. 31, 1981, incorporated by reference herein.

DESCRIPTION

1. Technical Field

This invention is in the field of magnetic pulse timers as utilized in ignition circuits of fuel burning engines.

2. Background Art

The prior art utilizes a magnetic pulse timer coupled to a semiconductor switch. Such semiconductor switch is both unipolar and usually dependent upon the DC power source used to energize the ignition system. Hence, when the power source drops in voltage level or rises in voltage level above the operating limit of the semiconductor switch, the combination of timer and semiconductor switch fails to trigger and activate the ignition system.

DISCLOSURE OF INVENTION

The instant invention utilizes a pair of semiconductor switches of opposite conductivities coupled to the timer winding. The input circuit to the pair of semiconductor switches of opposite conductivities is independent of any DC voltage or power input and hence will function no matter what level the DC power source voltage rises to or drops to. The output for such pair of switches produces more than double the conventional voltage output to trigger the power semiconductor or semiconductors of the ignition system.

DETAILED DESCRIPTION OF THE BEST MODE FOR CARRYING OUT THE INVENTION

Figure 1:
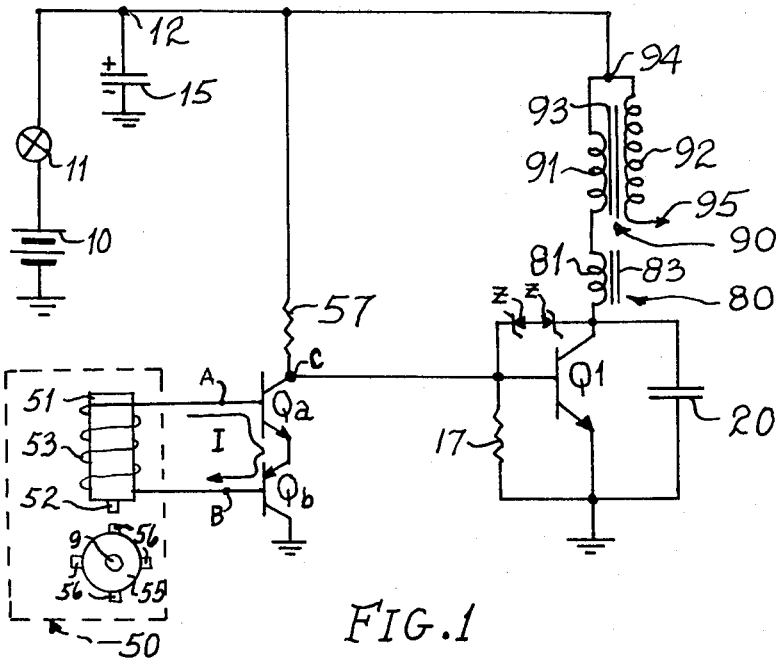
FIG. 1 is a schematic of the bipolar activated magnetic pulse timer in accordance with the invention.

Referring to FIGS. 1, 5, 6 and 7, magnetic pulse timer 50 in the illustrated ignition system is used to trigger a bipolar activated logic circuit comprised of transistors $Q_a$ and $Q_b$ of opposite semiconductor conductivities.

Transistor $Q_a$ is of the NPN type and transistor $Q_b$ is of the PNP type, emitter-to-emitter connected with leads A and B of magnetic pulse timer winding 53 connected to the bases of $Q_a$ and $Q_b$ respectively.

Timer 50 is otherwise conventional, having a permanent magnet core 51 upon which winding 53 is wound, and having a magnetic pole piece 52 used to magnetically sense pulses induced in winding 53 when reluctor rotor 55 having protrusions 56 thereon is driven by automotive distributor shaft 9, so that each time one of protrusions 56 passes pole piece 52, a voltage waveform as illustrated at F or G is induced in winding 53 at leads A and B.

Such waveform may be visually observed with an oscilloscope when leads A and B are not connected to the bases of transistors $Q_a$ and $Q_b$ and when such leads are connected to the oscilloscope's vertical input terminals.

Whether waveform F or G will be observed, will depend upon which of leads are connected to which of the vertical input terminals of the oscilloscope. One of the oscilloscope terminals is usually at ground potential whereas the other terminal is above ground potential. Consequently, assuming that the magnetic polarity established in core 51 and direction of turns of wire of winding 53 are such so as to render waveform F when A is connected to the oscilloscope terminal above ground potential, and B is connected to the oscilloscope terminal at ground potential, then transposing leads A and B with respect to the oscilloscope terminals will result in a display of waveform G. Since waveform F exhibits a conventional positive-going slope, from lower left to upper right direction, waveform F will be designated as possessing a positive slope, and conversely waveform G will be designated as possessing a negative slope.

Positive slope waveform F is generally preferred due to sharper switching cut-off characteristics exhibited thereby, although the negative slope waveform G may effectively be utilized by transposition of leads A and B to the base inputs of $Q_a$ and $Q_b$.

It is obvious that when rotor 55 is at standstill, no voltage will be induced in winding 53 and no waveform F or G will be present across leads A and B.

When DC voltage from battery 10 fed through ignition switch 11 is applied to the collector of $Q_a$ at C through resistor 57, and rotor 55 is driven by shaft 9, waveform voltage F having excursions of $\pm 10$ volts induced in winding 53 is applied between A and B to the bases of $Q_a$ and $Q_b$ to create base current I in both bases, thereby enabling collector current to flow in $Q_a$ and $Q_b$ between positive terminal 12 and ground, turning ON $Q_a$ and $Q_b$ to their conductive states and lowering the potential at C from a positive value to ground potential.

Assuming, that the magnetic switch is such as above described so as to provide waveform F between leads A and B, base current I will flow in both bases of $Q_a$ and $Q_b$ when the positive pulse component of waveform F is applied at A, in which situation B will be at a negative potential at the same instant of time, thereby establishing the base of $Q_a$ at a positive potential and the base of $Q_b$ at a negative potential, which are the required potentials to create base currents in both $Q_a$ and $Q_b$. Thus, collector current will flow in $Q_a$ and $Q_b$ to cause these transistors to simultaneously switch from their OFF or non-conductive to their ON or conductive states.

The collector at C is connected to the base of NPN power transistor Q1 which is switched between its ON and OFF states in accordance with the potential at C.

Transistor Q1 is protected against high voltages appearing between its collector and emitter during its OFF state by means of resistor 17 and zener diodes Z, and also by inductor 80 which serves to lower the collector-emitter voltage of Q1 during its OFF state. Zener diodes are back-to-back connected to provide bipolarity protection since the voltage across Q1 in its OFF state is bipolar. Accordingly, collector to base voltage of Q1 will be limited to the zener diode knee voltage, and base to ground voltage will be substantially limited to the zener knee voltage due to the low resistance value of resistor 17 connected between the base and emitter of Q1. With such connection, the combination of zener Z and resistor 17 effectively limits collector-emitter and collector-base voltages to the zener knee values and thereby protects Q1 in its OFF state.

The collector of Q1 is connected to winding 81 of charge accumulator inductor 80. Winding 81 is wound on a magnetizable core 83, generally of the torroidal type. The other end of winding 81 is connected to one end of primary winding 91 of a standard ignition transformer 90 of an 80:1 turns ratio as used in automotive ignition systems, the other end of winding 91 at 94 being generally a common connection terminal with one end of secondary winding 92. End 95 of winding 92 is the high voltage distribution point and is generally connected to a rotor of a high voltage distributor, not shown herein.

Capacitor 20, shunting collector-emitter terminals of Q1, may be optionally included. Capacitor 15 is a high capacitive low voltage electrolytic capacitor connected across the DC input terminals of the igniton circuit so as to provide a low AC current return path to compensate for inductance in the cables connecting the ignition circuit to DC power means of an automotive power source.

Briefly, when rotor 55 is at standstill, or when A is at a negative potential, C will be at a position potential and Q1 will be conductive to permit DC current to flow through windings 81 and 91 so as to charge those windings and cores 83 of inductor 80 and 93 of transformer 90, and capacitor 20, if used, will be short-circuited. When waveform F provides a positive potential at A thus also placing B at a negative potential, due to rotation of reluctance wheel 55, to cause protrusions 56 to pass pole piece 52, base current I in $Q_a$ and $Q_b$ will flow to cause $Q_a$ and $Q_b$ to conduct, thereby lowering point C through zero potential to a high negative potential to turn transistor Q1 to its OFF state, thereby discharging inductor 80 into winding 91 while also discharging winding 91 to induce a high voltage in winding 91 in accordance with the description thereof discussed in the referenced patent applications referred to above. If capacitor 20 is utilized, then the discharge currents from inductor 80 and winding 91 will pass therethrough in oscillatory fashion.

The benefit of bipolar timing switch $Q_a$ and $Q_b$ may be appreciated by examining the base to emitter voltage waveforms $V_{BE}$ of $Q_a$ and $Q_b$ illustrated as waveforms H and J, each having an amplitude of 7 volts. During conduction of $Q_a$ the base to emitter voltge $V_{BE}$ will drop from +7 volts to zero volts, whereas the base to emitter voltage $V_{BE}$ of $Q_b$ will rise from −7 volts to zero volts, thereby resulting in a base to base voltage between A and B of 14 volts, and $Q_a$ and $Q_b$ will simultaneously switch from their OFF to their ON states to turn Q1 from its ON to its OFF state.

Transistor Q1 will initially be conductive or in its ON state as shown by waveform K. The base to emitter voltage $V_{BE}$ of Q1 during its ON state will be at +2 volt potential, dropping sharply past zero potential level to about −11 volt potential for a short period of time, by virtue of point C undergoing these potential changes, to turn Q1 from its ON to its OFF state, and then turning Q1 back to its conductive or ON state when $Q_a$ and $Q_b$ are turned OFF by virtue of operation of timer 50.

The switching logic of the foregoing system may be briefly summarized in tabular form as follows:

| Protrusion 56 | Potential at A | Potential at B | $Q_a$ | $Q_b$ | Potential at C | Q1 | 81 & 91 |
|---|---|---|---|---|---|---|---|
| is not driven past armature 52 | 0 | 0 | OFF | OFF | +2 | ON | charge |
| is driven past armature 52 | + | − | ON | ON | −11 | OFF | discharge |

With respect to any of the configurations shown in FIGS. 1, 2, 3 or 4, an advantage is gained utilizing the trigger circuit of $Q_a$ and $Q_b$, in that such trigger activation by virtue of generation of waveform F or G as input to $Q_a$ and $Q_b$, makes triggering and switching initiation independent of the DC power source of the ignition system and consequently independent of its voltage and current variations.

It should also be noted that although a pair of NPN-PNP transistors were utilized for $Q_a$–$Q_b$, there appears to be no reason why a suitable pair of unijunction transistors of different conductivities or a pair of field effect transistors of different conductivities could not be used as substitutes.

Referring to FIGS. 2, 5, 6 and 7, timer 50 triggering $Q_a$ and $Q_b$, functions in the same manner as discussed in conjunction with FIG. 1, above. However, here resistor 58 is in the collector circuit of $Q_b$ and the collector terminal of $Q_b$ designated by letter D will be of importance in terms of triggering power transistor Q2. Here too, zener diodes Z are of the same values and connected between the collector and base of Q2, and resistor 18 and zener diodes Z perform the same function as resitor 17 and zener diodes Z of FIG. 1 configuration. Transistor Q2 is a PNP power transistor of opposite conductivity to that of Q1 and consequently the logic of the system will differ somewhat only in conjunction with turning Q2 ON and OFF. The components such as inductor 80 and winding 91 of transformer 90 will be situated in the collector circuit of Q2 and terminal 94 will be at ground potential, positive DC power being fed from terminal 12 to the collector of $Q_a$ and to the emitter of Q2. Otherwise the remaining components are similarly connected and function in similar manner to the same components discussed in conjunction with FIG. 1.

Accordingly, waveforms F, H and J are utilized in the same manner as discussed for FIG. 1. However, the waveform resulting for $V_{BE}$ of $Q_2$ is of reversed polarity to waveform K. Prior to conduction of $Q_a$ and $Q_b$, the base of Q2 is at a negative potential of about −2 volts when current flows through resistor 58 and Q2 is in its conductive state, thereby permitting inductor 80 and winding 91 to be charged by DC current from battery 10. When $Q_a$ and $Q_b$ are turned on, as discussed above in conjunction with FIG. 1, current I will flow in the bases of $Q_a$ and $Q_b$ and $Q_a$ and $Q_b$ will be in their conductive states raising the potential at D to a positive value and bringing the base of PNP transistor Q2 to its OFF state, thereby discharging inductor 80 and winding 91, as discussed above in conjunction with FIG. 1. In this configuration, voltage spikes of about +11 volts will appear at the base of Q2 as it rises from a negative to a positive potential to turn Q2 to its OFF state and permit components 80 and 91 to discharge.

Figure 2:
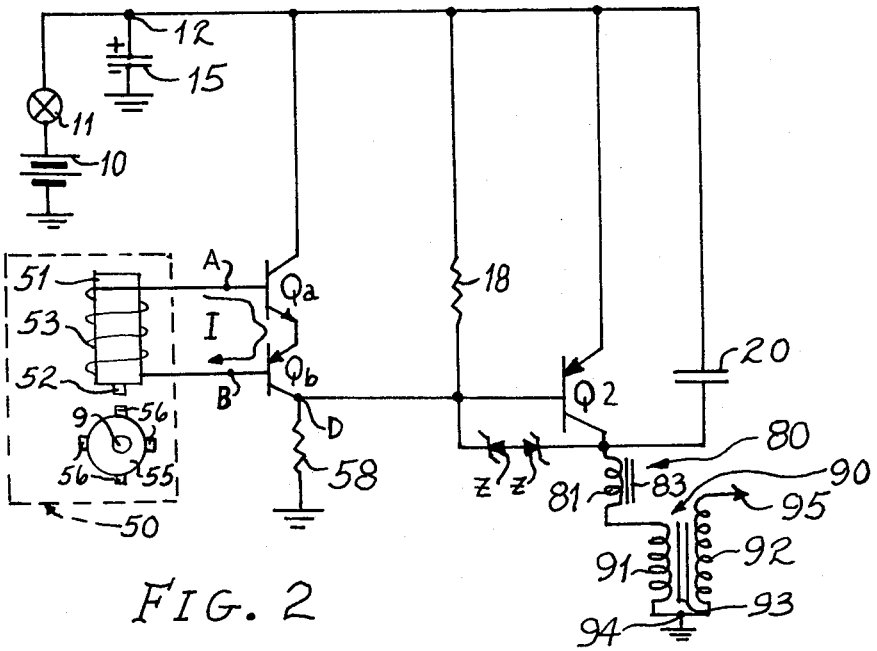
FIG. 2 is a schematic of the bipolar activated magnetic pulse timer used to drive another variation of ignition system.

The switching logic of FIG. 2 configuration may be briefly summarized in tabular form as follows:

| Protrusion 56 | Potential at A | Potential at B | $Q_a$ | $Q_b$ | Potential at D | Q1 | 81 & 91 |
|---|---|---|---|---|---|---|---|
| is not driven past armature 52 | 0 | 0 | OFF | OFF | −2 | ON | charge |
| is driven past armature 52 | + | − | ON | ON | +11 | OFF | discharge |

Figure 3:
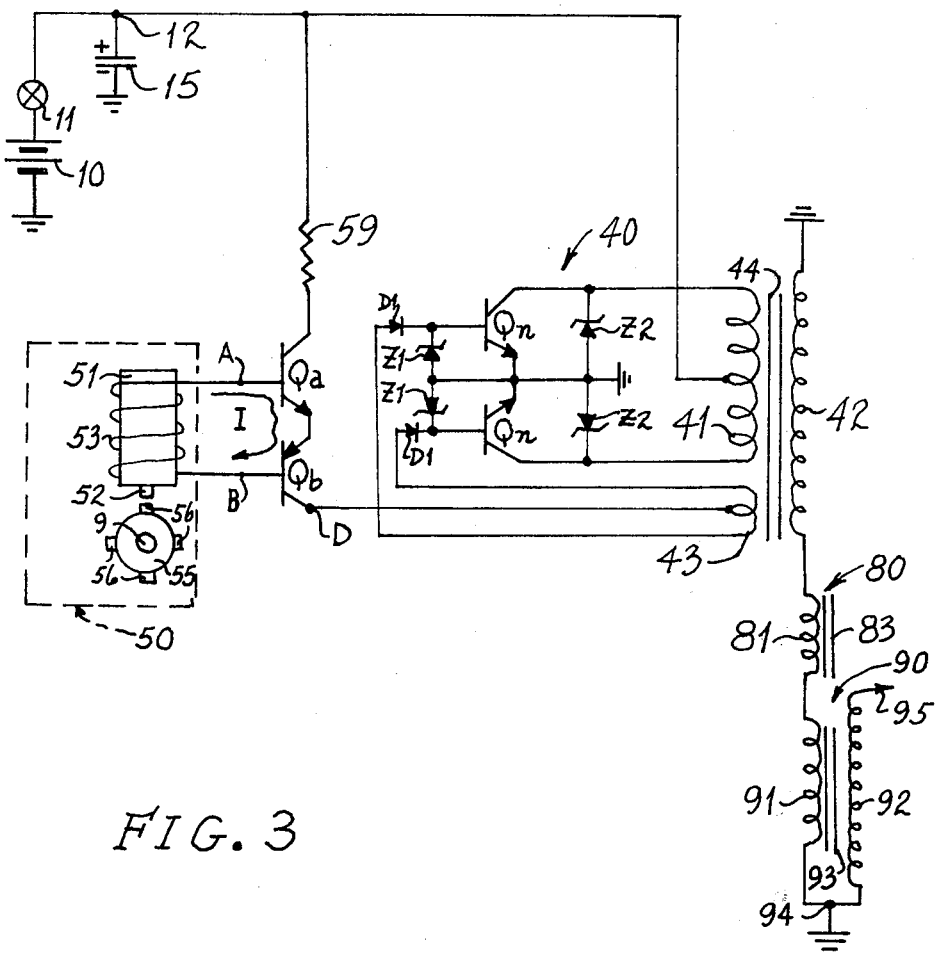
FIG. 3 is a schematic of the bipolar activated magnetic pulse timer used to drive an alternating current ignition system.
Figure 5:
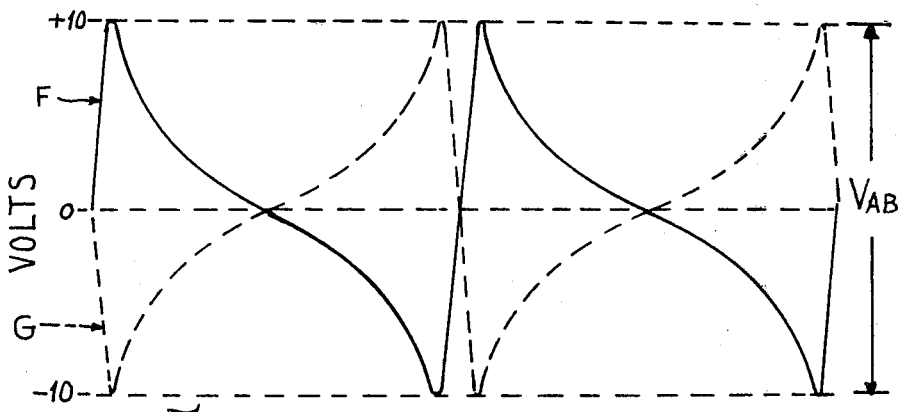
FIGS. 5, 6 and 7 are waveforms created by the circuit of FIG. 1.
Figure 6:
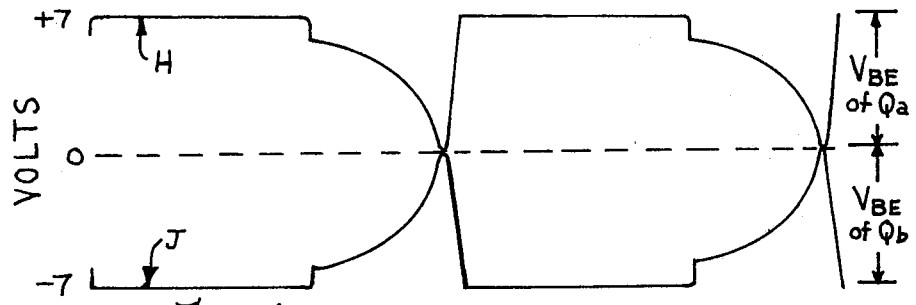
Figure 7:
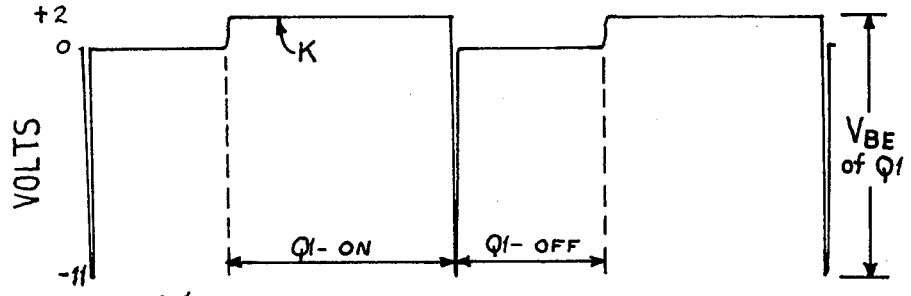

Referring to FIGS. 3 and 5, the bipolar trigger system of timer 50 with $Q_a$ and $Q_b$ transistors is used to turn ON alternating current generator 40. Operation of alternating current generator 40 as coupled to inductor 80 and transformer 90 is explained in detail in applicant's prior patent application Ser. No. 336,506 filed Dec. 31, 1981 and need not be repeated herein. All other common components and their operation has been discussed above in conjunction with FIGS. 1 and 2.

The method of coupling the bipolar circuit of $Q_a$ and $Q_b$ to generate 40 constitutes feeding DC current from battery 10 through resistor 59 to the bases of Qn transistors when $Q_a$ and $Q_b$ are in their ON states thereby causing point D to be raised to a positive potential fed to the center tap of winding 43 to turn the Qn transistors to their ON states in alternation during each ignition cycle. AC power will be supplied to winding 91 and instantaneous modulation of the voltage across winding 91 will be provided by cyclic discharges from inductor 80 into winding 91. A voltage pattern of such modulation is also illustrated in application Ser. No. 336,506. Functions of protective diodes D1, Z1 and Z2 are also discussed in such application Ser. No. 336,506.

Figure 4:
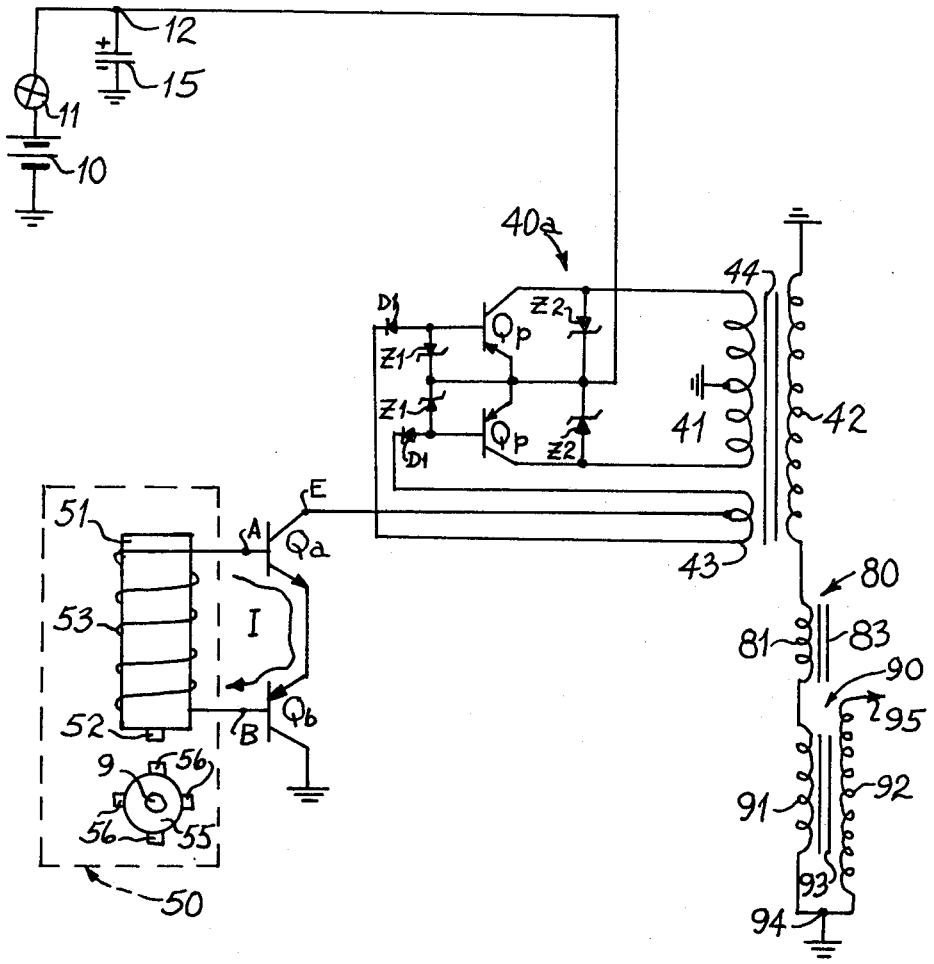
FIG. 4 is a schematic of the bipolar activated magnetic pulse timer used to drive another alternating current ignition system.

Referring to FIGS. 4 and 5, the bipolar trigger system of timer 50 with $Q_a$ and $Q_b$ transistors is used to turn ON alternating current generator 40*a*. Operation of alternating current generator 40*a* coupled to inductor 80 and transformer 90 is explained in detail in applicant's prior filed patent application Ser. No. 336,506 filed Dec. 31, 1981 and need not be repeated herein. All other common components and their operation has been discussed above in conjunction with FIGS. 1 and 2.

The method of coupling the bipolar circuit of $Q_a$ and $Q_b$ to generator 40*a* constitute connecting the collector of $Q_a$ at E to the center tap of winding 43, and connecting the collector of $Q_b$ to ground. Hence, when $Q_a$ and $Q_b$ are in their conductive states, point E will be at ground potential to cause base current to flow in transistors Qp, and cause transistors Qp to turn ON in alternation during each ignition firing cycle, feeding AC power to winding 42 and windings 81 and 91. Modulation of AC generated power by discharges from inductor 80 into winding 91 are the same as referred to above in conjunction with FIG. 3 and also as illustrated in application Ser. No. 336,506. Functions of protective diodes D1, Z1 and Z2 are also discussed in such application Ser. No. 336,506.

Typical commercially available components utilized in configurations of FIGS. 1 through 4 are as follows:

| Component | Value or Type |
|---|---|
| $Q_a$ | 2N3773 or 2N3055H |
| $Q_b$ | 2N6609 |
| Q1 | MJ 15024 Motorola, or 2N6547 |
| Q2 | MJ 15025 Motorola |
| Qn | MJ 15024 Motorola, or 2N3773 |
| Qp | MJ 15025 Motorola, or 2N6609 |
| D1 | 2.5 Ampere, 100 volts |
| Z | 1N5388 |
| Z1 | 1N5341 |
| Z2 | 1N5388 when Qn or Qp is MJ 15024 or MJ 15025; 1N5381 when Qn or Qp is 2N3773 or 2N6609 |
| 15 | 250 microfarad electrolytic, 50 volts |
| 20 | 0.25 microfarad, 400 volts |
| 17, 18 | 50 ohm, 0.5 watts |
| 57, 58 | 100 ohm, 2 watts |
| 59 | 50 ohm, 2 watts |

I claim:

1. A bipolar activated magnetic pulse timer for an ignition system of a fuel burning engine, comprising the combination of:

a pair of semiconductor switches of opposite conductivities, each of said switches having an input and an output circuit, the output circuits of said switches being serially connected; and a magnetic pulse timer having an output winding, said output winding being connected to the input circuits of said switches.

2. The invention as stated in claim 1, wherein one of said switches is of the NPN type and the other of said switches is of the PNP type.

3. The invention as stated in claim 1, wherein one of said switches is of the NPN type and the other of said switches is of the PNP type, and wherein the serially connected output circuits constitutes the conection of the emitter of the NPN switch to the emitter of the PNP switch.

4. The invention as stated in claim 1, wherein one of said switches is of the NPN type and the other of said switches is of the PNP type, and wherein connection of the output winding of the magnetic pulse timer to the input circuits of the switches constitutes the connection of said output winding to the bases of said switches.

5. The invention as stated in claim 1, including a charging circuit comprising a power transistor, an inductor and a primary winding of an ignition transformer connected to each other, the output circuits of said switches being coupled to the power transistor.

6. The invention as stated in claim 1, including an alternating current generator coupled to said output circuits, and an inductor and primary winding of an ignition transformer coupled to said alternating current generator.

* * * * *